US012534861B2

(12) United States Patent
Taylor

(10) Patent No.: US 12,534,861 B2
(45) Date of Patent: Jan. 27, 2026

(54) RIGID MODULAR TRAFFIC BARRIER CONNECTIONS

(71) Applicant: Pro-Cast Products, Inc., Highland, CA (US)

(72) Inventor: Warren G. Taylor, Costa Mesa, CA (US)

(73) Assignee: Pro-Cast Products, Inc., Highland, CA (US)

( * ) Notice: Subject to any disclaimer, the term of this patent is extended or adjusted under 35 U.S.C. 154(b) by 593 days.

(21) Appl. No.: 17/935,207

(22) Filed: Sep. 26, 2022

(65) Prior Publication Data

US 2023/0096302 A1 Mar. 30, 2023

Related U.S. Application Data

(60) Provisional application No. 63/261,739, filed on Sep. 28, 2021.

(51) Int. Cl.
*E01F 15/08* (2006.01)

(52) U.S. Cl.
CPC ..... *E01F 15/088* (2013.01)

(58) Field of Classification Search
CPC ..... E01F 15/08; E01F 15/081; E01F 15/083; E01F 15/085; E01F 15/086; E01F 15/088; E04F 11/1834; E04H 17/1404
USPC ..... 256/13.1
See application file for complete search history.

(56) References Cited

U.S. PATENT DOCUMENTS

| | | | | |
|---|---|---|---|---|
| 4,661,010 | A * | 4/1987 | Almer | E01F 15/088 404/9 |
| 4,828,425 | A * | 5/1989 | Duckett | E01F 15/006 256/13.1 |
| 6,203,242 | B1 * | 3/2001 | Englund | E01F 15/088 256/13.1 |
| 7,144,188 | B1 * | 12/2006 | Mallinson | E01F 15/088 404/6 |
| 9,976,266 | B1 | 5/2018 | Rosenbaugh et al. | |
| 12,331,473 | B2 * | 6/2025 | Scott, III | E01F 15/088 |

FOREIGN PATENT DOCUMENTS

| | | | | |
|---|---|---|---|---|
| DE | 19943229 | A1 * | 4/2001 | E01F 15/088 |
| EP | 1063357 | A1 * | 12/2000 | E01F 15/083 |
| FR | 2862672 | A1 * | 5/2005 | E01F 15/088 |

(Continued)

OTHER PUBLICATIONS

American Association of State Highway and Transportation Official (AASHTO), "Manual for Assessing Safety Hardware," Second Edition, pp. 1-283 (2016).

(Continued)

*Primary Examiner* — Josh Skroupa
(74) *Attorney, Agent, or Firm* — Weatherly IP Solutions, LLC; James M. Weatherly

(57) ABSTRACT

Systems, apparatuses, and methods for the connection of modular traffic barriers, where loop connectors, such as pin and loop or hook connectors, are integrated into each end of a barrier allowing the ends of two barriers to be aligned to allow the protruding loops of a loop connector on one end of a barrier to align and connect with the loops of a loop connector on the end of the second barrier, allowing for tension and compression of each end of each barrier.

27 Claims, 14 Drawing Sheets

(56) References Cited

FOREIGN PATENT DOCUMENTS

| | | | | |
|---|---|---|---|---|
| FR | 2954367 B1 * | 9/2014 | ..... | E01F 15/088 |
| WO | WO-2011014131 A1 * | 2/2011 | ..... | E01F 15/083 |
| WO | WO-2019147114 A1 * | 8/2019 | ..... | E01F 15/08 |

OTHER PUBLICATIONS

Oregon Department of Transportation—Engineering, "RD500 Series—Concrete Barrier Standard Drawing Report," pp. RD500, RD505, RD510, RD515-RD516, RD520, RD526, RD530, RD535, RD545, RD550, RD560, RD570, RD575, RD680, RD581, and RD590 (Jan. 19, 2019).

State of California—Department of Transportation—Caltrans, "J-J Hooks Temporary Concrete Barrier," pp. JJ01-R2 (Sheet 1 of 5) to JJ03-R2 (Sheet 3 of 5) (Mar. 19, 2021).

State of California—Department of Transportation—Caltrans, "J-J Hooks Temporary Concrete Barrier," pp. JJ04-R1 (Sheet 4 of 5) (Mar. 19, 2021).

State of California—Department of Transportation—Caltrans, "Portable Concrete Barrier (Type 60K)," Sheets A63A, A63B, T3A, and T3B (May 31, 2018).

* cited by examiner

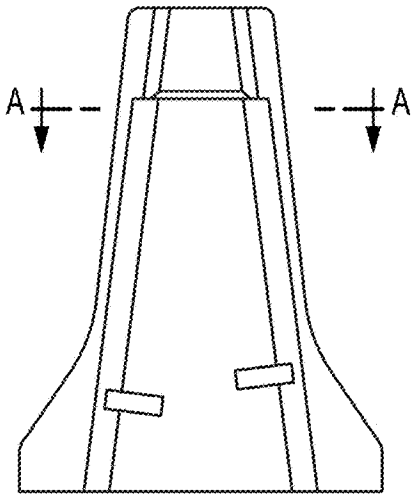
FIG.13A
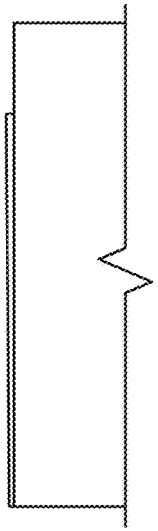
FIG.13B
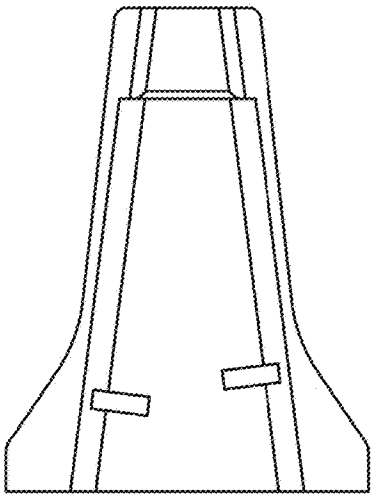
FIG.13C
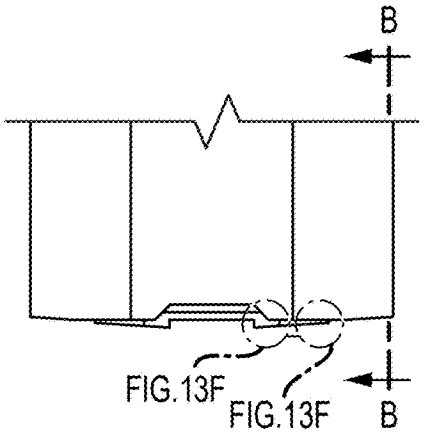
FIG.13D
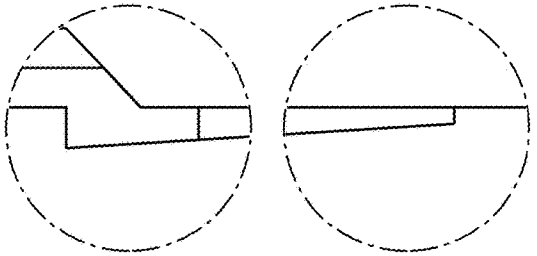
FIG.13E
FIG.13F
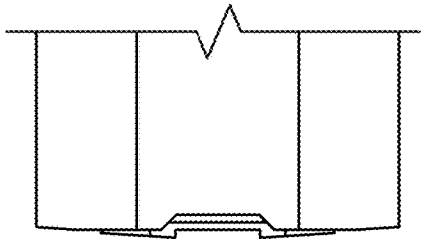
FIG.13G

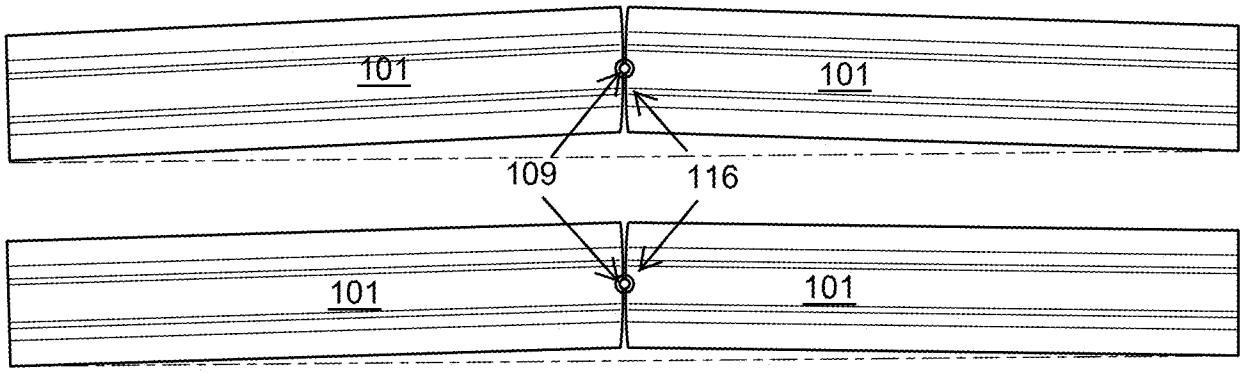
FIG.14e
FIG.14d
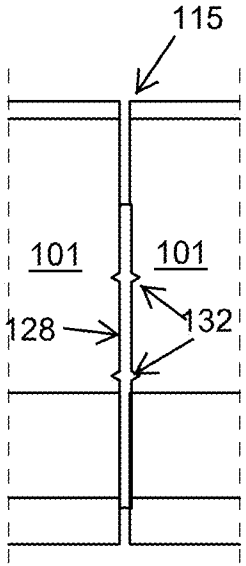
FIG.14c
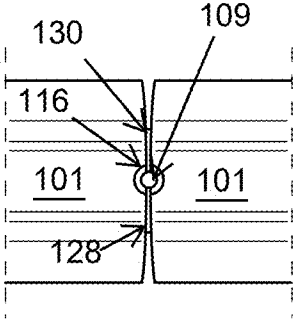
FIG.14b
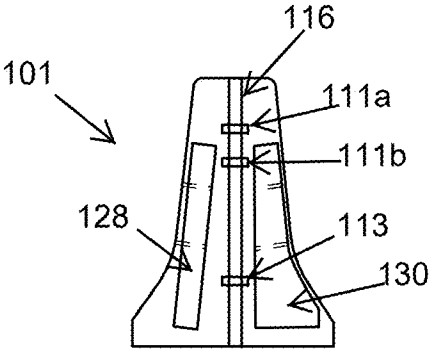
FIG.14a

RIGID MODULAR TRAFFIC BARRIER CONNECTIONS

CROSS REFERENCE TO RELATED MATTER

The present application claims priority to U.S. Application No. 63/261,739, as filed on Sep. 28, 2021, the entire contents of which are incorporated herein by reference for all purposes.

SUMMARY

The following embodiments and aspects thereof are described and illustrated in conjunction with systems, tools, and methods, which are meant to be exemplary and illustrative, not limiting in scope.

An embodiment of the present invention provides a modular traffic barrier, wherein the barrier comprises: a first end having a top, a centerline, a first side and a second side; a second end having a top, a centerline, a first side and a second side; at top, a bottom, a first side and a second side; at least two ridges protruding from said first end of said barrier and at least two ridges protruding from said second end of said barrier, wherein said at least two ridges on the first end and said at least two ridges on said second end allows for a more uniform impact on said first end and said second end of the barrier during a vehicle collision; at least one loop bar connector operably integrated into the first end of the barrier and at least one loop bar connector operably integrated into the second end of the barrier, wherein said integration allows for at least two loops from each of said at least one first loop bar connector to extend from the first end of the barrier and the at least one second loop bar connector to extend from the second end of the barrier; wherein each of said at least two loops are configured to allow at least one pin to span through said at least two loops of the loop bar connectors as integrated into the barrier; and at least one pin recess integrated into the first end of said barrier and at least one pin recess integrated into the second end of said barrier, wherein each of said pin recess is configured to allow at one pin to span through said pin recess; and at least two loop recesses integrated into said first end of said barrier and at least two loop recesses integrated into said second end of said barrier, wherein each of said at least two loop recesses is allows a loop from an end of a second barrier to be integrated within an end of the barrier.

An embodiment of the present invention provides a system for connecting modular traffic barriers, where the system comprises: two barriers, wherein each barrier comprises: a first end having a top, a centerline, a first side and a second side; a second end having a top, a centerline, a first side and a second side; at top, a bottom, a first side and a second side; at least two ridges protruding from said first end of said barrier and at least two ridges protruding from said second end of said barrier, wherein said at least two ridges on the first end and said at least two ridges on said second end allows for a more uniform impact on said first end and said second end of the barrier during a vehicle collision; at least one loop bar connector operably integrated into the first end of the barrier and at least one loop bar connector operably integrated into the second end of the barrier, wherein said integration allows for at least two loops from each of said at least one first loop bar connector to extend from the first end of the barrier and the at least one second loop bar connector to extend from the second end of the barrier; wherein each of said at least two loops are configured to allow at least one pin to span through said at least two loops of the loop bar connectors as integrated into the barrier; and at least one pin recess integrated into the first end of said barrier and at least one pin recess integrated into the second end of said barrier, wherein each of said pin recesses is configured to allow at one pin to span through said pin recess; and at least two loop recesses integrated into said first end of said barrier and at least two loop recesses integrated into said second end of said barrier, wherein each of said at least two loop recesses is allows a loop from an end of a second barrier to be integrated within an end of the barrier; and at least one pin, wherein said at least one pin is configured to span through the loops of the loop bar connectors as integrated into the barrier, allowing the first end of the barrier to be operably coupled to the first end or second end of a second barrier by aligning the first end of the barrier with the first end or second end of the second barrier and aligning the loops of the first barrier with the loops of the second barrier to allow at least one pin to span through said at least one loop of the first barrier and through said at least one loop of said second barrier.

An embodiment of the present invention provides a method for connecting modular traffic barriers, wherein the method comprises: providing two barriers, wherein each barrier comprises: a first end having a top, a centerline, a first side and a second side; a second end having a top, a centerline, a first side and a second side; at top, a bottom, a first side and a second side; at least two ridges protruding from said first end of said barrier and at least two ridges protruding from said second end of said barrier, wherein said at least two ridges on the first end and said at least two ridges on said second end allows for a more uniform impact on said first end and said second end of the barrier during a vehicle collision; at least one loop bar connector operably integrated into the first end of the barrier and at least one loop bar connector operably integrated into the second end of the barrier, wherein said integration allows for at least two loops from each of said at least one first loop bar connector to extend from the first end of the barrier and the at least one second loop bar connector to extend from the second end of the barrier; wherein each of said at least two loops are configured to allow at least one pin to span through said at least two loops of the loop bar connectors as integrated into the barrier; and at least one pin recess integrated into the first end of said barrier and at least one pin recess integrated into the second end of said barrier, wherein each of said pin recess is configured to allow at one pin to span through said pin recess; and at least two loop recesses integrated into said first end of said barrier and at least two loop recesses integrated into said second end of said barrier, wherein each of said at least two loop recesses is allows a loop from an end of a second barrier to be integrated within an end of the barrier; and providing at least one pin, wherein said at least one pin is configured to span through the loops of the loop bar connectors as integrated into the barrier, allowing the first end of the barrier to be operably coupled to the first end or second end of a second barrier by aligning the first end of the barrier with the first end or second end of the second barrier and aligning the loops of the first barrier with the loops of the second barrier to allow at least one pin to span through said at least one loop of the first barrier and through said at least one loop of said second barrier.

BRIEF DESCRIPTION OF THE FIGURES

The accompanying drawings, which are incorporated herein and form a part of the specification, illustrate some, but not the only or exclusive, example embodiments and/or features. It is intended that the embodiments and figures disclosed herein are to be considered illustrative rather than limiting.

FIG. 13*a* is an elevation view of the end of the modular traffic barrier of the current disclosure showing the taper at the top of the barrier and at the bottom of the barrier.

FIG. 13*b* is an elevation view of the top of the modular traffic barrier showing the taper of the end of the barrier.

FIG. 13*c* is an elevation view of the end of the modular traffic barrier from the center line of the barrier.

FIG. 13*d* is a plan view of the barrier from the top of the barrier looking down on the end of the barrier, showing the draft and taper of the end of each barrier.

FIG. 13*e* is a blown-up plan view of the taper at the top of the end of the modular traffic barrier.

FIG. 13*f* is a blown-up plan view of the taper at the bottom of the end of the modular traffic barrier.

FIG. 13*g* is a plan view of the top of the end of the modular traffic barrier showing the work line of the barrier in view of the taper.

FIG. 14*a* is an elevation view of the end of a barrier with a single pin connection and two deflection spacers.

FIG. 14*b* is an elevation view of the top of a one pin connection between two modular traffic barriers with two deflection spacers filling in the gaps.

FIG. 14*c* is an elevation view from the side showing the connection of a one pin connection between two barriers with a deflection spacer filling in the gap.

FIG. 14*d* is an elevation view of two barriers 101 connected to each other by one pin 109*a*. As shown in FIG. 14*d*, the one pin connection between the two barriers allows for more flexibility in the pivot point between the two barriers, allow curves to be created in the barriers with different articulations.

FIG. 14*e* is an elevation view of two barriers 101 connected to each other by one pin 109*a* with a larger curve at the pivot point of the pin.

DETAILED DESCRIPTION

Figure 1:
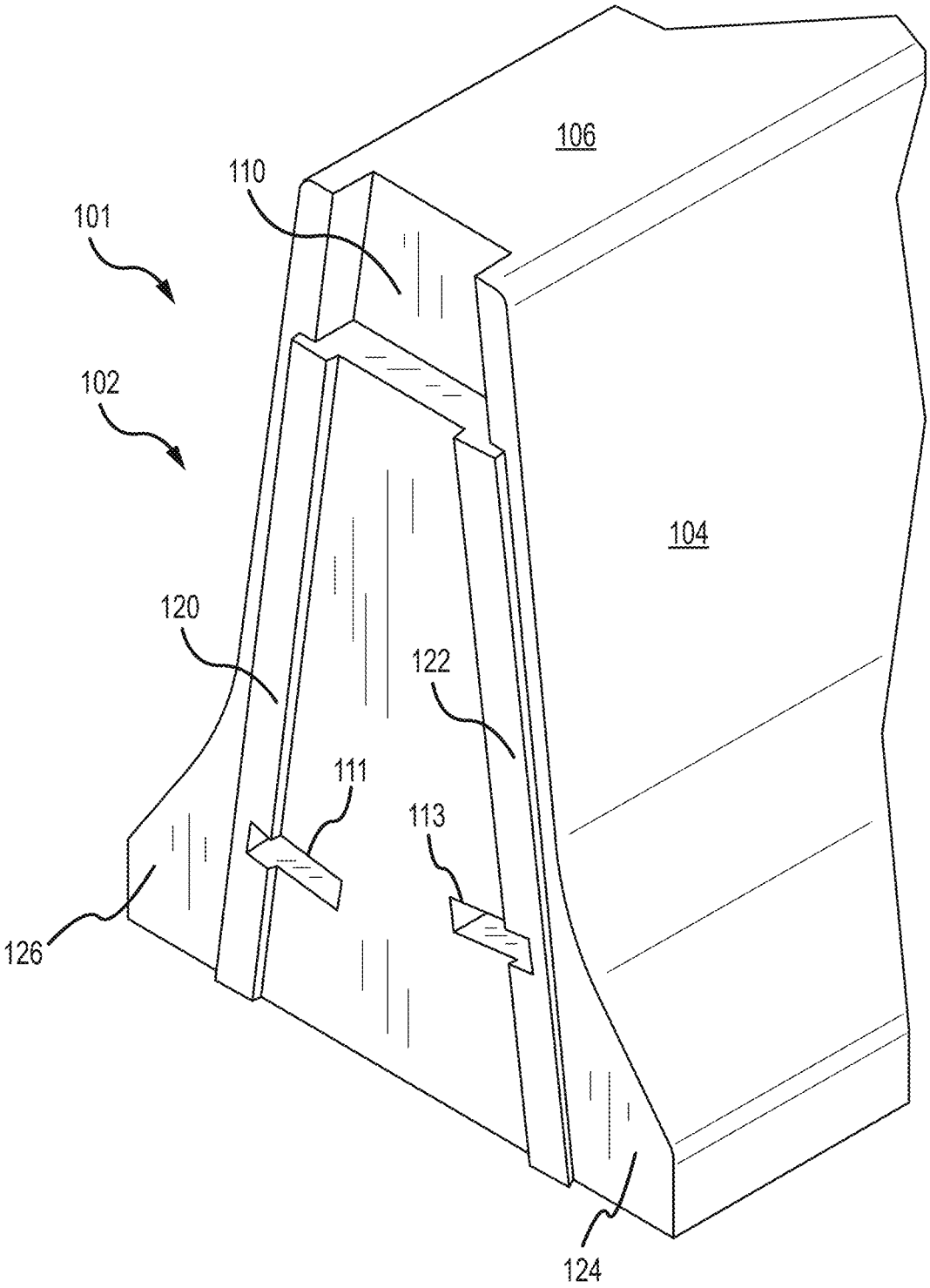
FIG. 1 is a perspective view of the first end of a barrier showing loop recesses.

Embodiments of the present disclosure provide systems, apparatuses, and methods for the connection of modular traffic barriers to limit the deflection and roll during a vehicular impact with the barriers. As described in more detail herein, the current disclosure provides a barrier where connectors, such as pin and loop or hook connectors, that are integrated into each end of a barrier. The loop connectors are designed to form two, four or more loops that extend or protrude from the end of each end of each barrier. The ends of two barriers are aligned to allow the protruding loops of a loop connector on one end of a barrier to align with the loops of a loop connector on the end of the second barrier. Once aligned, one or two steel pins (depending on the number of loops of each loop connector) are inserted into the loops of the loop connectors such that each pin spans the loops extending from the end of each barrier. Each end of the barrier may also have one or more tapers (shown in FIGS. 7-9*b*) allowing for tension and compression of each end of each barrier, allowing the barriers to be connected in straight lines or to allow for a curve in the connections between barriers. Where gaps are created between the connections of two barriers, deflection spacers, such shims, blocks or wedges, may be sized to fill in the space between the connections may be used.

As will be discussed in more detail below, the loop connectors that are integrated into each end of each barrier create a moment connection between two barriers that utilizes connection pins spanning the loops created between the loop connectors and the barriers, allowing for both tension and compression. In another embodiment, the pins of the pin and loop connections may also be used as a deflection spacer. In this embodiment, the pins, once spanning the loops of two loop connectors, are capable of compressing against the concrete to stop the movement of the barrier in a collision. In this embodiment, two or more pins may be used in the pin and loop connections, acting as a deflection spacer to limit the movement of the barrier.

Currently, cement or concrete barriers that are approved for highway safety use, once installed, require that pins (stakes) are driven into the ground after the barriers are installed in place. These pins (stakes) are driven through pockets in the barriers and in most cases up to 4' through the asphalt and ground with 3-4 of these pins required (6-8 for installations where traffic is on both sides) to limit the deflection during a vehicle impact. When the barriers are to be removed, the pins have to be removed and the holes in the asphalt or ground have to be filled. The loop connections of the current disclosure strengthen the stability of the barriers and allow for barriers to be installed and connected in such a manner that eliminate or reduce the need for pinning barriers.

In an embodiment, deflection spacers, such as shims, wedges or blocks (such as RL-77¼" Ridged Shim available from Meadow Burke), may be incorporated into the gaps at the connection point of two barrier ends. The use of shims, wedges or blocks incorporated into the gaps on the ends of the barriers close the gaps between the barriers and don't allow the barriers to open up. Closing the gaps with shims, blocks or wedges eliminates or significantly reduces the deflection during an impact. The shims or blocks may be made of a number of materials, including hi-impact plastic, synthetic rubber or may be cast in place using concrete or cement.

As shown in FIG. 1, a perspective view of the first end of a concrete barrier 101 is provided. The barrier 101 in FIG. 1 shows the first end 102 of the barrier 101, the barrier's 101 first side 104, the top 106 of the barrier 101 and the second side 105 of the barrier 101. A pin head recess 110 is shown at the intersection of the top 106 of the barrier 101 and the first end 102. This pin head recess 110 is designed to allow room for the top loops and two pins that will connect two barriers (not shown). Also shown in FIG. 1 are two loop recesses 111 and 113 which are also designed to allow the lower loops of the loop connectors space without bumping into the end of the barrier 101.

While the barrier of FIG. 1 is described as concrete, a variety of materials may be used, including cement, steel, steel frame and plastics, as will be understood by one skilled in the art.

The end 102 and 103 of each barrier 101 is designed with elevated ridges 120 and 122 which are designed so that during a vehicle impact with the barriers, the ends of two barriers to impact or hit each out in the middle of each end. The elevated ridges 120 and 122 are designed to allow for a more uniform impact on the ends of the barriers with more energy and compression from the impact along the middle or center line of the end 102 or 103 of the barrier 101, thus reducing the impact and energy deflected to the toes 124 and 126 of each of side 104 and 105 and therefore reducing the damage to the toes 124 and 126. As shown in FIG. 1, the elevated ridges are flat, with no taper, however in another example and embodiment of the present disclosure, as shown in FIGS. 7, 8, 9*a*, 9*b*, 13*d*, 13*e*, 13*f* and 13*g*, the elevated ridges may be tapered with the greatest depth or width of the taper closest to the center line of the end of the barrier.

Figure 2:
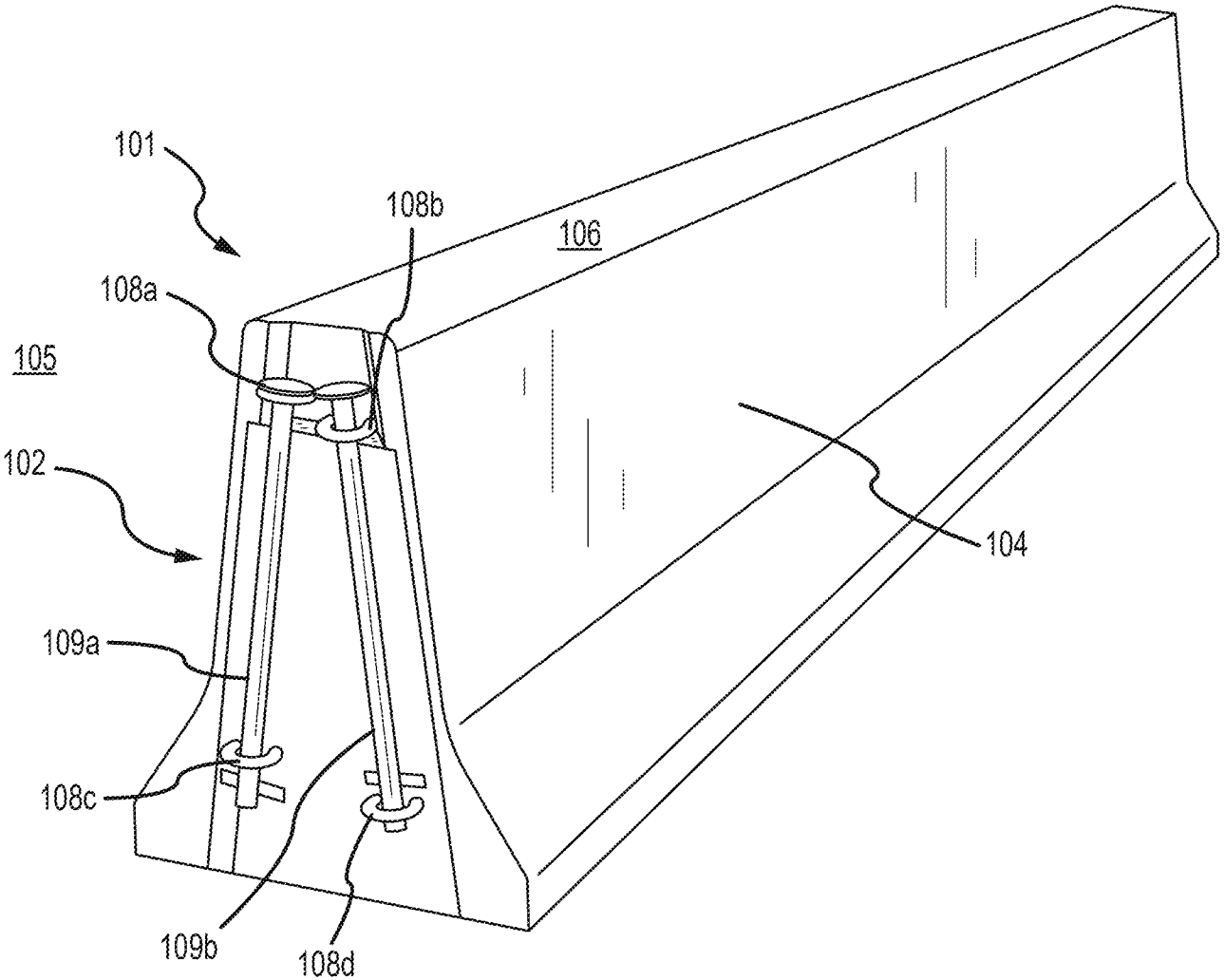
FIG. 2 is a perspective view of a barrier with two pins spanning through the loops of a loop connector on the first end of the barrier.

FIG. 2 provides a perspective view of a modular traffic barrier 101 with two pins 109*a* and 109*b* spanning through the loops 108*a*, 108*b*, 108*c*, 108*d* of a loop connector on the first end 102 of the barrier 101 (104 is the first side of the barrier, 105 is the second side of the barrier, 106 is the top of the barrier and 103 is the second end). As shown in FIG. 2, loops (108*a*, 108*b*, 108*c*, and 108*d*) extend from the first end 102 of the barrier 101. A first pin, 109*a*, spans through loops 108*a* and 108*c* and the second pin 109*b* spans through loops 108*b* and 108*d*.

As will be understood by one skilled in the art, while two pins are shown in this figure, other configurations and numbers of pins, including embodiments with one, two, three or four pins (used with loop connectors with two, four, six or eight loops), may be available. Pins and loop connectors may be made of several materials, including steel and all pins and loop connectors may be hot-dip galvanized after fabrication. As will also understood by one skilled in the art, while the pins of FIG. 2 are cylindrical in shape, a number of shapes may be available, depending on the needs of the connection, including but not limited to square, rectangular, round, oval, and hexagon. As will also be understood by one skilled in the art, the shape of the loop of the loop connection will be the same as the shape of the pin, such the loop connection may also be a number of shapes, including but not limited to square, rectangular, round, oval, and hexagon.

While pin and loop connectors are show and described in FIG. 2 and throughout this disclosure, a variety of connectors may be used to connect to barriers, including but not limited to, pin and loop connectors and J-J hook connections.

J-J hook connections consist of two metal, such as steel, J-shaped or hook shaped hooks, where the hooks are cast in place into the end of a barrier, creating a continuous steel connection. Barrier ends are connected to each other by lowering the end of one barrier next to a second barrier, causing the J hooks from each barrier to interlock together.

The barrier shape is designed to reduce the possibility of roll of the barrier as well as cracking or spalling at the toe or edges of the barrier. The top 106 of the barrier is 9.0" to 9.5" in width to provide more stability at the height of the barrier. As used herein, roll is an impact that causes a barrier to roll over.

Figure 3:
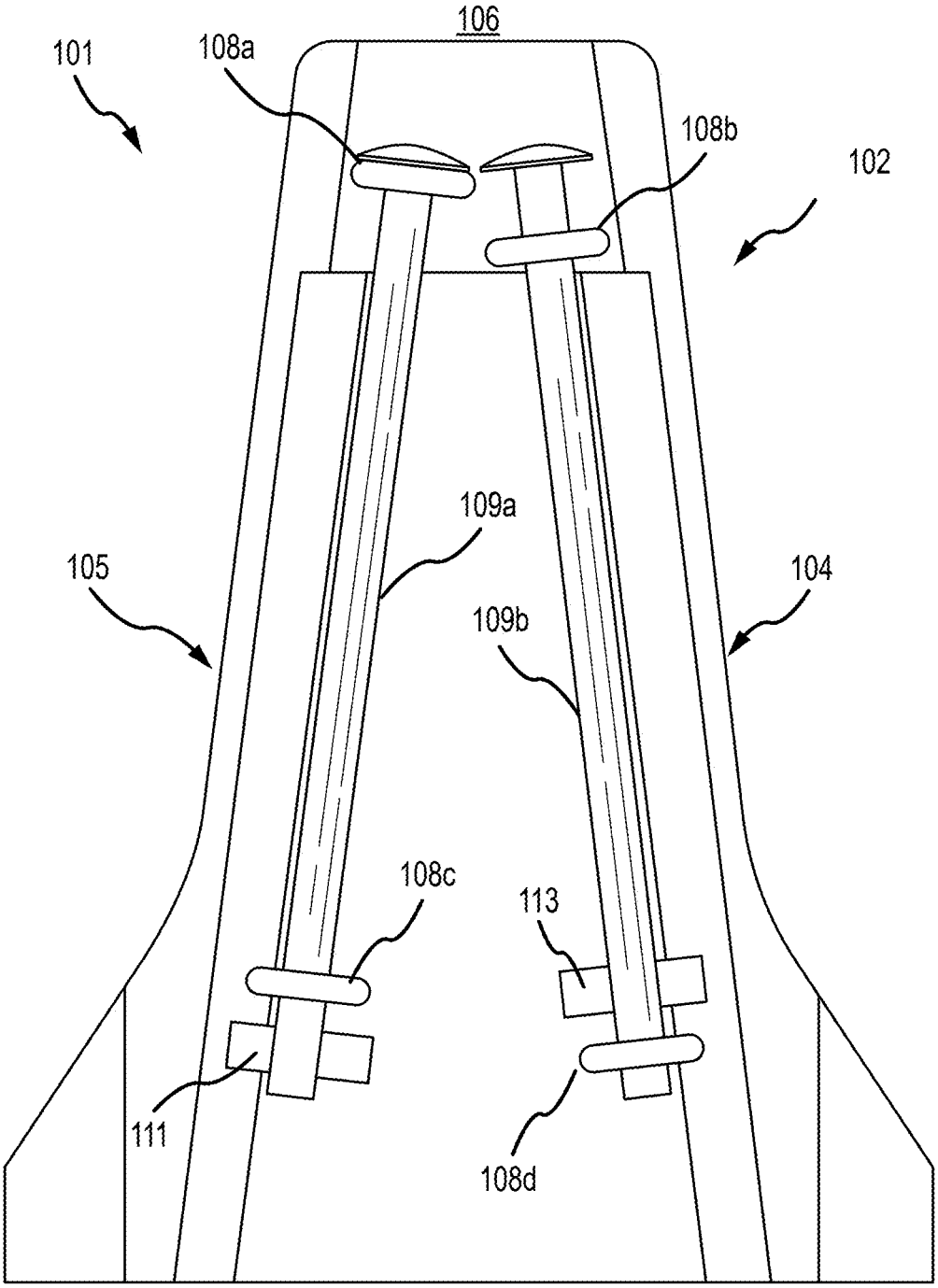
FIG. 3 is an elevation view of the first side of a barrier with two pins spanning through the loops of a loop connector.

FIG. 3 provides another view of the first end 102 of a modular traffic barrier 101 with two pins 109*a* and 109*b* spanning through the loops 108*a*, 108*b*, 108*c*, and 108*d* of a loop connector (nor fully shown in FIG. 3). As shown in FIG. 3 and discussed in FIG. 2, loops (108*a*, 108*b*, 108*c*, 108*d*) extend from the first end 102 of the barrier 101. A first pin, 109*a*, spans through loops 108*a* and 108*c* and the second pin 109*b* spans through loops 108*b* and 108*d*.

Figures 4A, 4B:
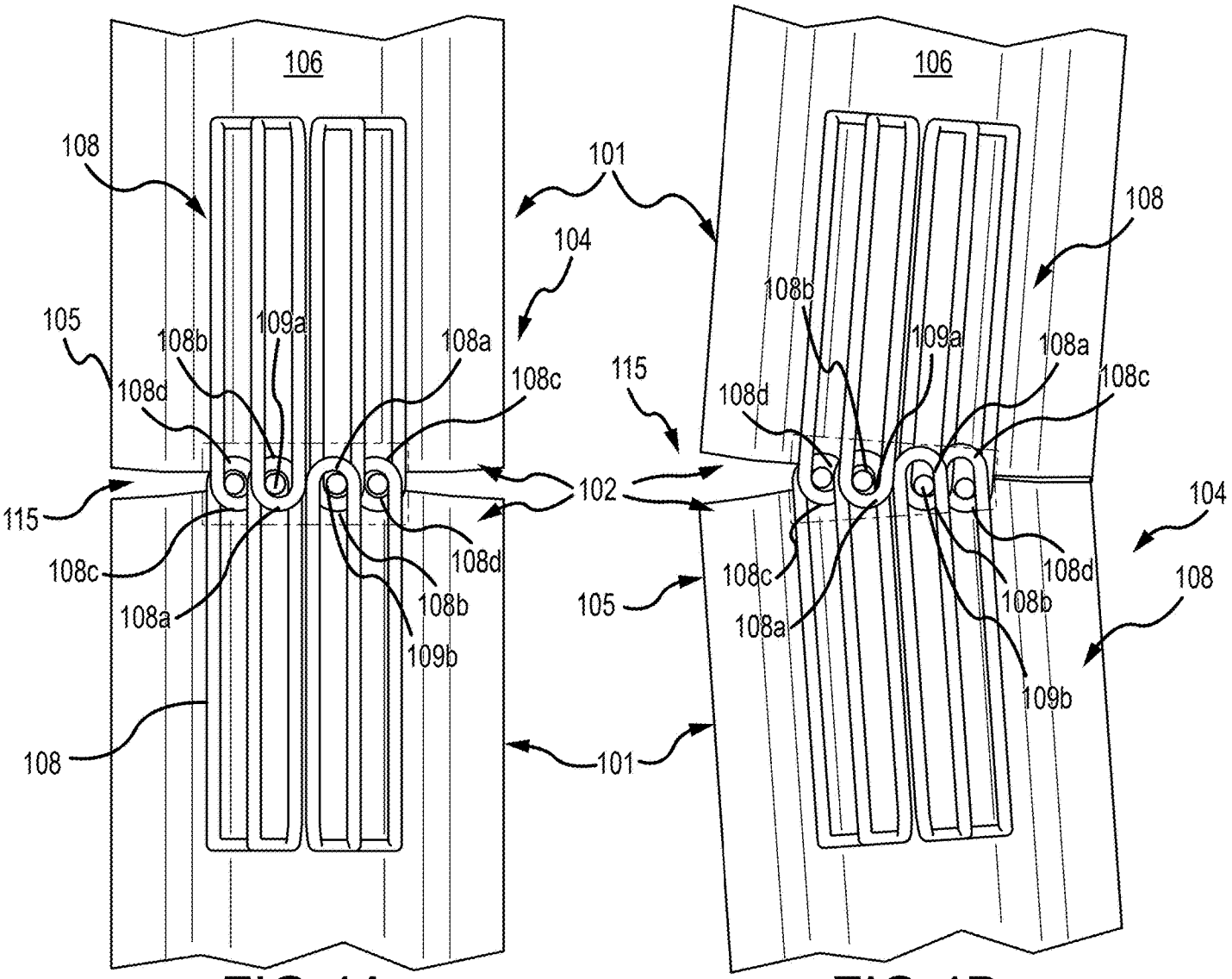
FIG. 4*a* is an elevation and transparent view of two barriers connected to each other by pins spanning loops from loop connectors integrated into each barrier.
FIG. 4*b* is an elevation and transparent view of two barriers connected to each other by pins spanning loops from loop connectors integrated into each barrier with no gap between barriers on one angle.

FIG. 4*a* is an elevation and transparent view of two barriers 101 connected to each other by pins 109*a* and 109*b* spanning loops 108*a*, 108*b*, 108*c*, and 108*d* from loop connectors 108 integrated into each barrier 101. As shown in FIG. 4*a*, two loop connector systems, 108 are integrated into the first end 102 or second end 103 of each barrier 101. As will be understood by one skilled in the art, several means are available to integrate each loop connector 108 into the barrier, such as, but not limited to the time of casting of the modular traffic barrier.

As further shown in FIG. 4*a*, each loop connector 108 is integrated in such a way to allow for the four loops 108*a*, 108*b*, 108*c*, 108*d* of the loop connector to protrude or extend from the first end 102 or second end 103 of the barrier 101. Two pins 109*a* and 109*b* connect the two barriers 101 by spanning through the loops 108*a*, 108*b*, 108*c*, and 108*d*, of each loop connector 108 of each barrier 101 with the first pin, 109*a*, spanning through loops 108*a* and 108*c* from the first barrier and loops 108*b* and 108*d* from the second barrier and the second pin 109*b* spans through loops 108*b* and 108*d* of the first barrier and loops 108*a* and 108*c* of the second barrier.

The loop connector system 108 is shown with a configuration of two loop bars with a hook on the end of each loop bar that is integrated into the barrier, holding the loop bar in place within the barrier. Two steel risers elevate from the steel hooked end to two steel horizontal bars, approximately 24" in length that extend and are connected by a curved end that creates the loop. Two descending pieces descend from the hooked end of the loop connector to two horizontal bars, approximately 24" in length that extend to a curved end that created a second loop. The two loop bars are integrated into each end of the barrier, creating a loop connector 108 with four loops. The loop connectors may be made of a number of materials, including steel with hooks integrated onto the connectors to help stabilize and keep the loop connectors in place.

As will be understood by one skilled in the art, shims may also be used to fill gaps created between barriers to further limit the deflection during impact or change the modular traffic interface and pin locations.

As will be discussed in further detail in FIGS. 7-9*b* and FIGS. 13*a* to 13*g*, FIG. 4*a* further shows the tapers of each end (102 and 103) of each barrier 101, which provide an angular gap 115 between the barriers 101 at the connection point.

FIG. 4*b* is a repeat of FIG. 4*a*, however in FIG. 4*b*, the connector loop 108 is in a tension and compression state, with no gap between the barriers 101 on the right side 104 of the barrier connection. The lack of a gap between the barriers 101 allows the barriers to curve in either a left or right direction, depending on the needs of the situation.

Figure 5:
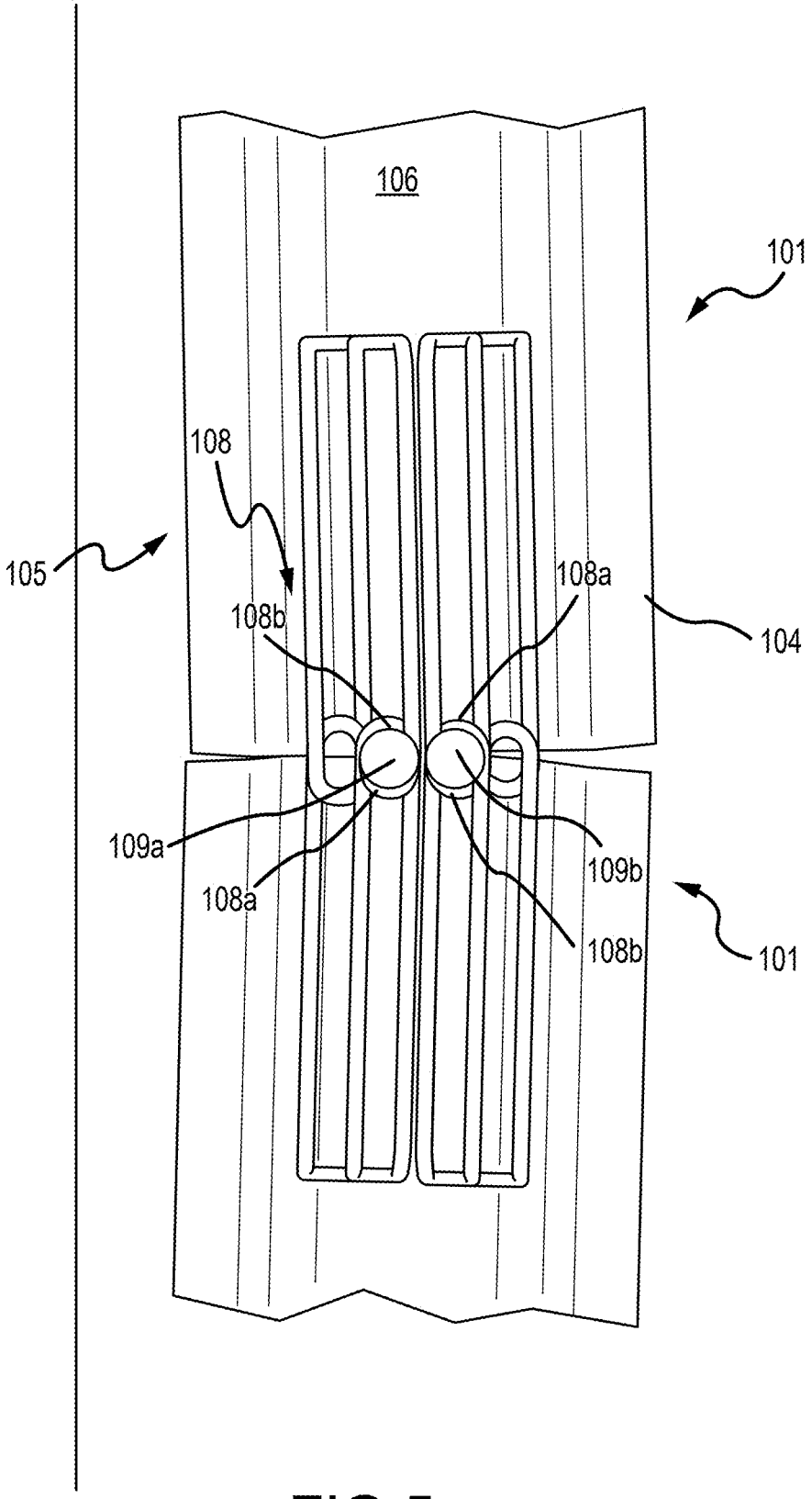
FIG. 5 is an elevation and transparent view of two barriers connected to each other by pins spanning loops from loop connectors integrated into each barrier with no gap between barriers on one angle and showing the pivot point of the connection on one pin.

FIG. 5 is another example of two barriers 101 in a tension and compression state. In this example, there is no gap on the left side 105 of the barrier. As shown in FIG. 5, each loop connector 108 is integrated in such a way to allow for the four loops 108*a*, 108*b*, 108*c*, 108*d* of the loop connector to protrude or extend from the first end 102 or second end 103 of the barrier 101. Two pins 109*a* and 109*b* connect the two barriers 101 by spanning through the loops 108*a*, 108*b*, 108*c*, 108*d*, of each loop connector 108 of each barrier 101 with the first pin, 109*a*, spanning through loops 108*a* and 108*c* from the first barrier and loop 108*b* and 108*d* from the second barrier and the second pin 109*b* spans through loops 108*b* and 108*d* of the first barrier and loops 108*a* and 108*c* of the second barrier. In this example, the pins 109*a* and 109*b* are able to roll in the loops of the connection, allowing the pins to be in a compression or tension state. This example shows a 5.7" movement in the gap between the barriers with the center of the right pin 109*b* as the pivot point, resulting in curve in the connection of the barriers to the left. It should be noted that the ability of the pins to roll will be available when the pins are round or cylindrical in shape. As will be understood by one skilled in the art, there will be no roll for embodiments with square or non-rounded shaped pins and corresponding loops in the loop connections.

FIG. 5 provides an example showing the connection between two barriers. As discussed above, the end 102 and 103 of each barrier 101 is designed with elevated ridges designed for the ends of two barriers to impact or hit each other in the middle of each end during a vehicle collision. This is shown in FIG. 5 with the red arrow showing the 5.7" movement, where while the left side of the connection of the two barriers are touching, the touch point is toward the center of the barriers and not on the edge of the barriers or toe. The elevated ridges are designed to allow for a more uniform impact with more energy and compression from the impact along the middle or center line of the end of the barrier 101, thus reducing the impact and energy deflected to the toes of each of side 104 and 105 and therefore reducing the damage to the toes.

Figure 6:
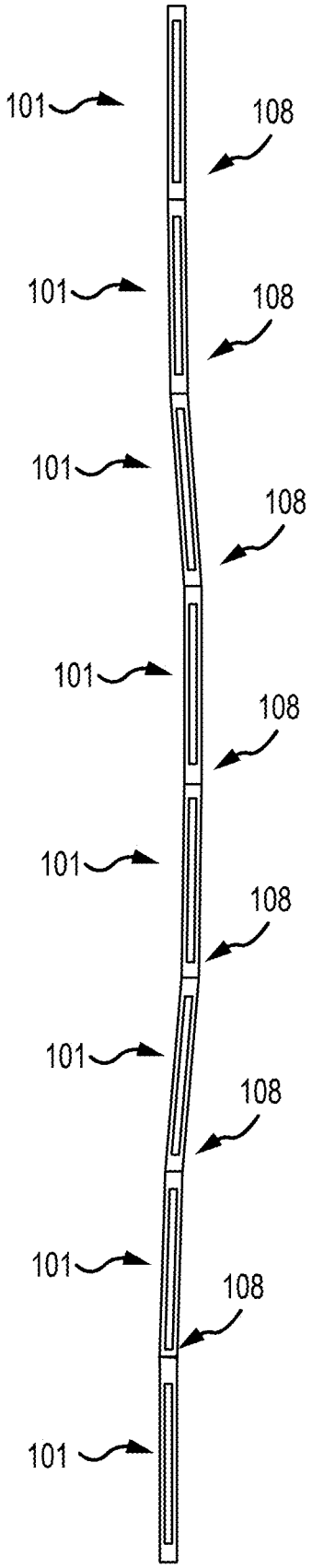
FIG. 6 is an elevated view of a chain of eight barriers connected by the loop connections of the present disclosure.

FIG. 6 is an example of a chain of eight modular traffic barriers 101 connected together by the loop connections 108 of the present disclosure. In FIG. 6, the chain of eight modular traffic barriers 101 are shown in a line that bends or curves to the right and then left and then back to a straight line. In this example, curves in the line of barriers take place at the connection 108 points where there is no gap between the barriers 101, causing the barriers 101 to curve in the direction of the connection 108 where there is no gap allowing for 2' to 4' of movement in the curve. As discussed above, in an embodiment of the present disclosure, shims or blocks may be incorporated into the gaps at the connection point of two barrier ends. The use of shims or blocks incorporated into the gaps on the ends of the barriers close the gaps between the barriers and don't allow the barriers to open up. Closing the gaps with shims will eliminate or significantly reduce the deflection and roll during an impact.

Figure 7:
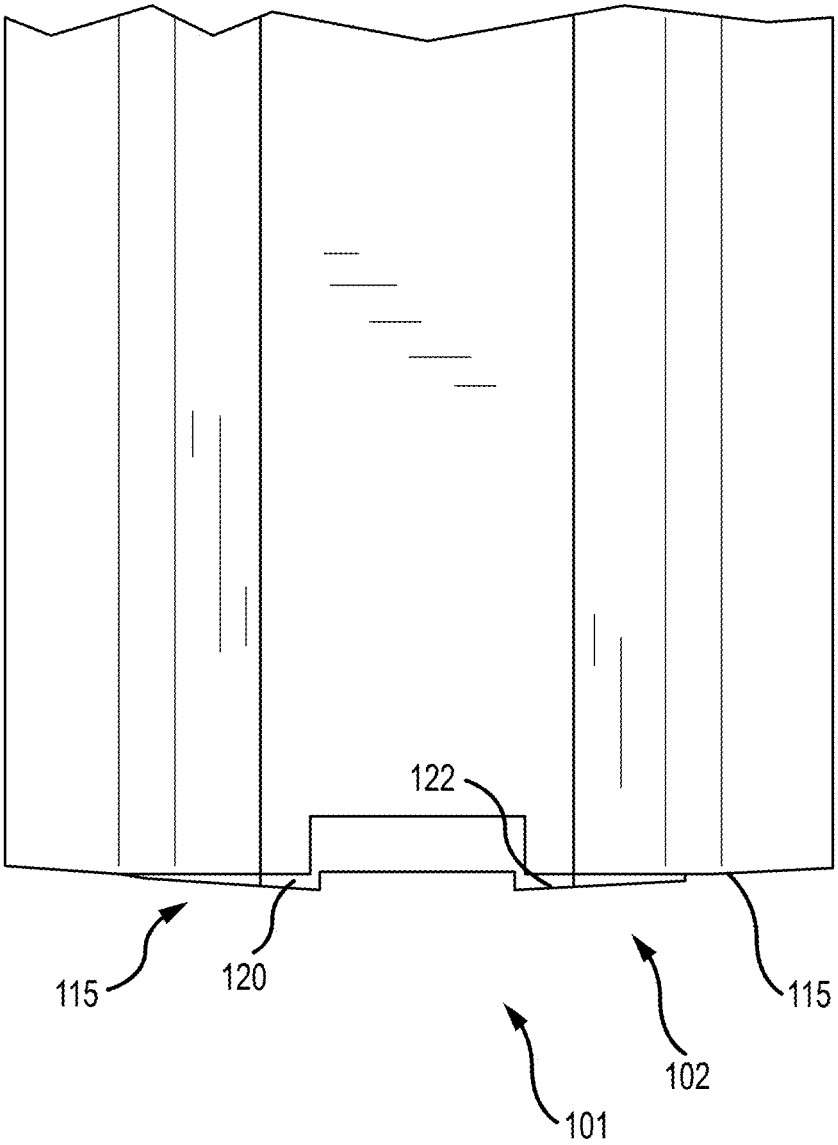
FIG. 7 is an elevation view of the first end of a barrier, showing the tapers on each side of the end of the barrier, including the elevated ridges.

FIG. 7 provides an elevation view of the first end of a barrier, showing the tapers on each side of the end of the barrier. As shown in FIG. 7, by way example, the end of the barrier has a taper on each side of the end of 3.576° from the center point of the barrier 101. The taper allows for the gaps to form on the end of each barrier as well as allows the line of barriers to curve in a direction where the gaps are closed. Also shown in FIG. 7 are the elevated ridges 120 and 122 at the end of the barrier 101. The ridges 122 and 120 are designed for the ends of two barriers to impact or hit each other in the middle of each end during a vehicle collision. The elevated ridges 120 and 122 are designed to allow for a more uniform impact with more energy and compression from the impact along the middle or center line of the end 102 or 103 of the barrier 101. While a taper 3.576° is provided herein, as will be understood by one skilled in the art a range of degrees of taper may be used depending on the needs of the barriers, with tapers from 0.5°, 1.1°, 1.8°, 2.67°, 3.4°, 4.4°, 6.8°, 9.0° 11.0°, 15.0°, 20.0° and all integers in between.

Figure 8:
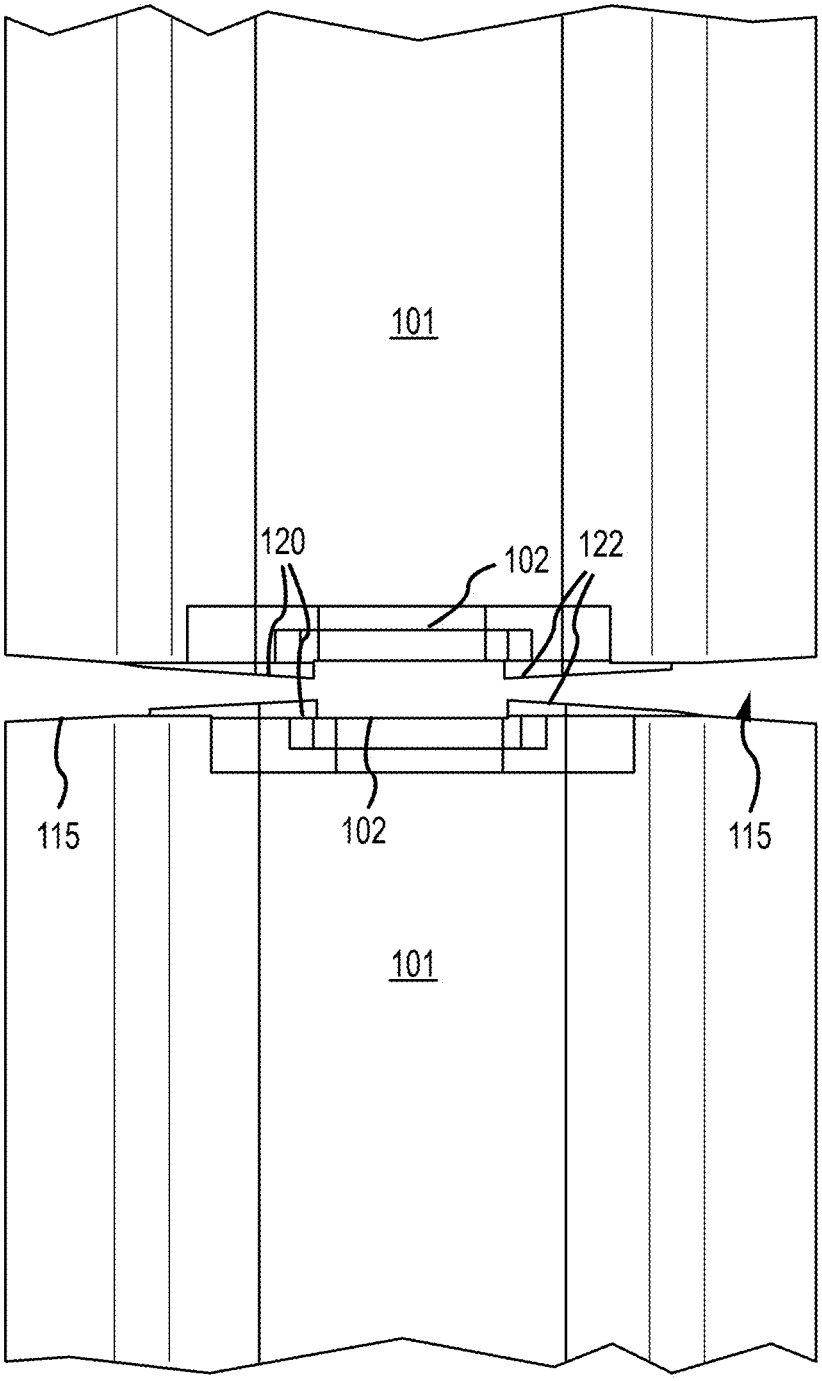
FIG. 8 is an elevation view of the connection between two barriers, showing the gap between the barriers created by the taper in each of the barriers.

FIG. 8 is an example of two barriers elevation view of the connection between two barriers 101, showing the gap 115 between the barriers 101 created by the taper 115 in each of the barriers 101. As shown in FIG. 8, the ends 102 of the barrier 101 has a taper 115 on each side that creates a gap of 1.75". The taper allows for the gaps to form on the end of each barrier 101 as well as allows the line of barriers to curve in a direction where the gaps are closed. In an embodiment, the gaps shown in FIG. 8, 115 may be filled using shims or blocks. As discussed above, the shims incorporated into the gaps 115 on the ends 102 or 103 of the barriers 101 enable the gaps between the barriers to be closed and eliminate or significantly reduce the deflection and roll during an impact. FIG. 8 also provides an example of the elevated ridges 120 and 122 as the ends of two barriers 101. The ridges 122 and 120 at the end of each barrier are designed for the ends of two barriers to impact or hit each other in the middle of each end during a vehicle collision to allow for a more uniform impact across the entire end of the barrier with more energy and compression from the impact along the middle or center line of the end 102 or 103 of the barrier 101.

Figures 9A, 9B:
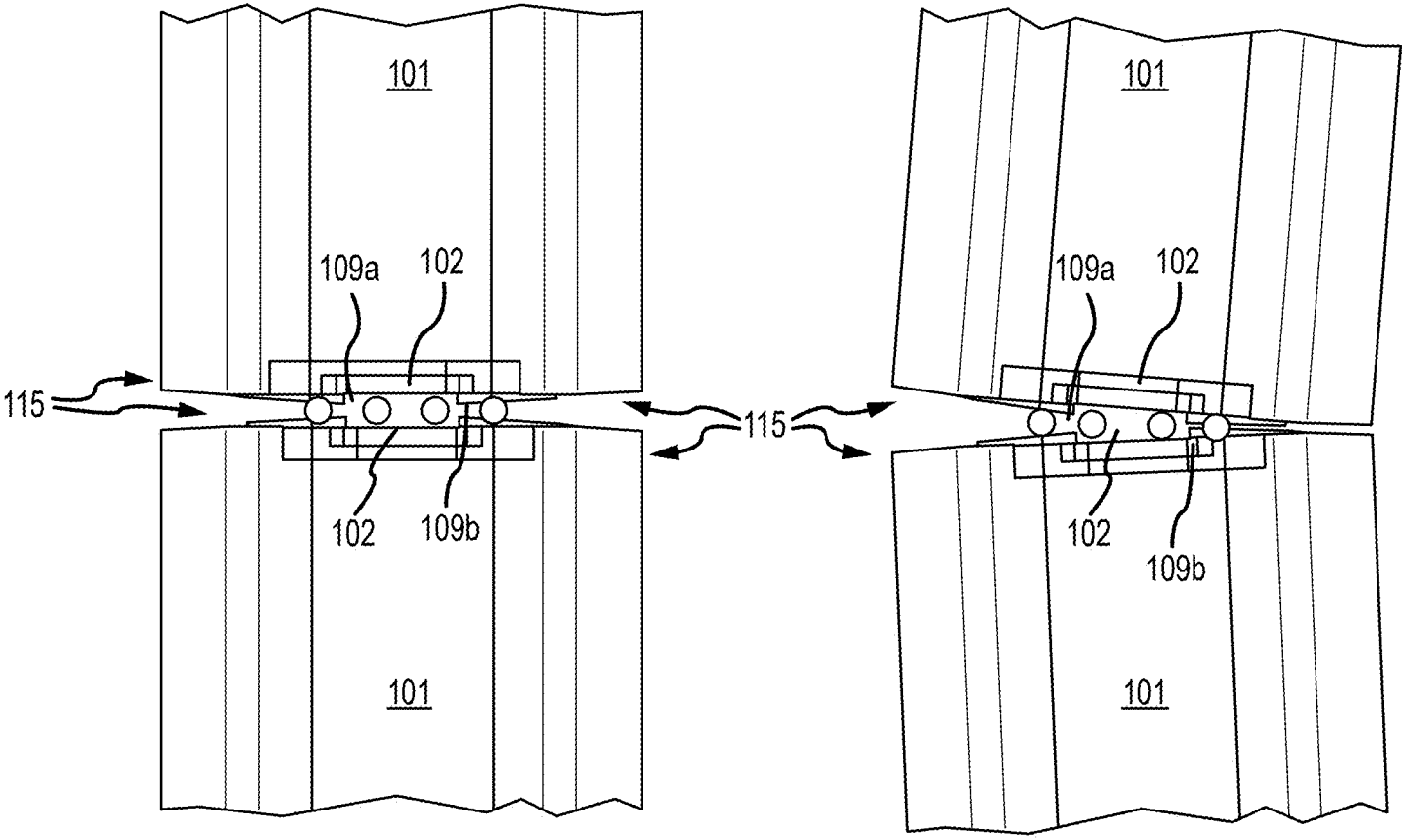
FIG. 9*a* is an elevation and transparent view of two barriers connected to each other by pins with even gaps between barriers.
FIG. 9*b* is an elevation and transparent view of two barriers connected to each other by pins with no gap between barriers on one angle and showing the pivot point of the connection on one pin.

FIG. 9*a* is an elevation view of two barriers 101 connected to each other by pins 109*a* and 109*b* with even gaps 115 between barriers 101. As shown in FIG. 9*a*, the ends 102 of the barrier 101 has a taper that produces a gap 115 on each side of the connection between the two barriers 101. In an embodiment, the gaps shown in FIG. 9*a*, 115 may be filled using shims, wedges or blocks. As discussed above, the shims incorporated into the gaps 115 on the ends 102 or 103 of the barriers 101 enable the gaps between the barriers to be closed and eliminate or significantly reduce the deflection and roll during an impact.

FIG. 9*b* is an elevation view of two barriers 101 connected to each other by pins 109*a* and 109*b* with no gap between barriers on the right side of the connection of the two barriers 101 with a gap on the left side of the connection. As shown in FIG. 9*b*, the taper at each end of the barrier produces a gap 115 on the opposite side of the end where the barriers 101 are touching, as shown in the right side of the connection. This creates a large gap 115 on the left side of the connection between the two barriers 101 and causes the barriers to curve to the right. In an embodiment, as discussed herein, the gaps shown in FIG. 9*b*, 115 may be filled using shims or blocks. As discussed above, the shims incorporated into the gaps 115 on the ends 102 or 103 of the barriers 101 enable the gaps between the barriers to be closed and eliminate or significantly reduce the deflection and roll during an impact.

Figure 10:
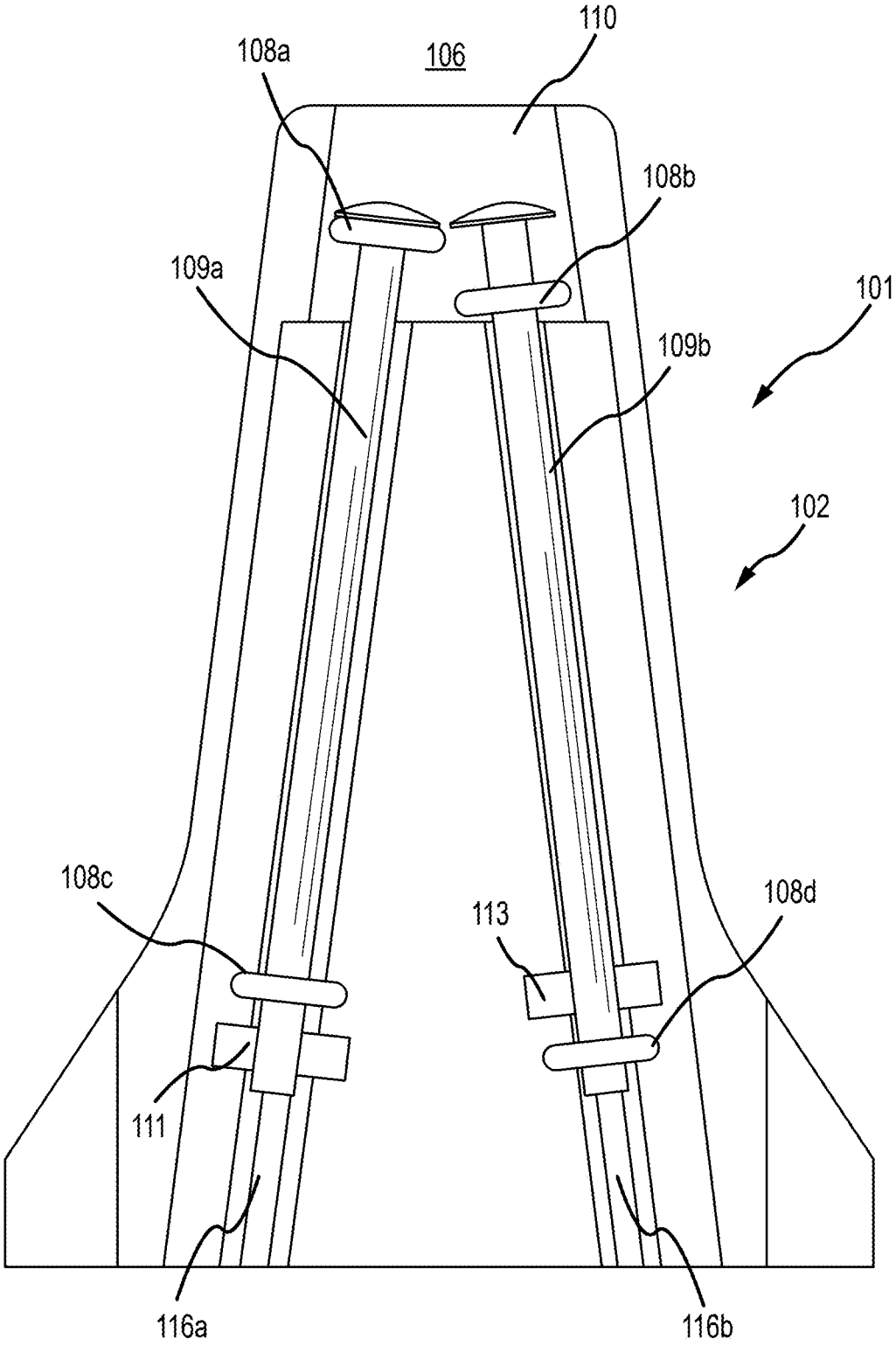
FIG. 10 is a front elevation view of the first end of a barrier showing loop recesses and pin recesses for tight and rigid connections between barriers.

FIG. 10 provides a front elevation view of the first end 102 of a modular traffic barrier 101 with loop and pins for a rigid connection and no taper or a minimal amount of taper on the ends to allow for a rigid connection between barriers. As shown in FIG. 10, a barrier 101 is provided with two pins 109*a* and 109*b* spanning through the loops 108*a*, 108*b*, 108*c*, and 108*d* of a loop connector (nor fully shown in FIG. 10). Pin recesses 116*a* and 116*b* are integrated into the barrier 101 end 102 to allow for pins 109*a* and 109*b* to sit within the end 102 of the barrier 101. As shown in FIG. 10, loops (108*a*, 108*b*, 108*c*, 108*d*) extend from the first end 102 of the barrier 101. A first pin, 109*a*, travels the length of the first pin recess 116*a* and spans through loops 108*a* and 108*c* and the second pin 109*b* travels the length of the second pin recess 116*b* and spans through loops 108*b* and 108*d*, with the heads of each pin 109*a* and 109*b* within the pin head recess 110 located at the top 106 of the barrier 101. Loop recesses 111 and 113 are located toward the bottom of the barrier 101 and correspond to the location of loops from other loop connectors from other barriers. The pin recesses, loop recesses and the recess at the top of the barrier allow for the pins and loops to be integrated within the end of the barrier without having to stick out, allowed the for the ends of two barriers to connect in a tight manner.

The configuration of FIG. 10 is designed for relatively straight runs without curves where the barriers are connected and pinned together in a tight or rigid formation with the ends of each barrier touching or almost touching. In this configuration, the barrier ends have a recess where the pin drops down and recesses where the loops protrude into the opposite barrier. This configuration also limits deflection and roll but without the need for shims.

Figure 11:
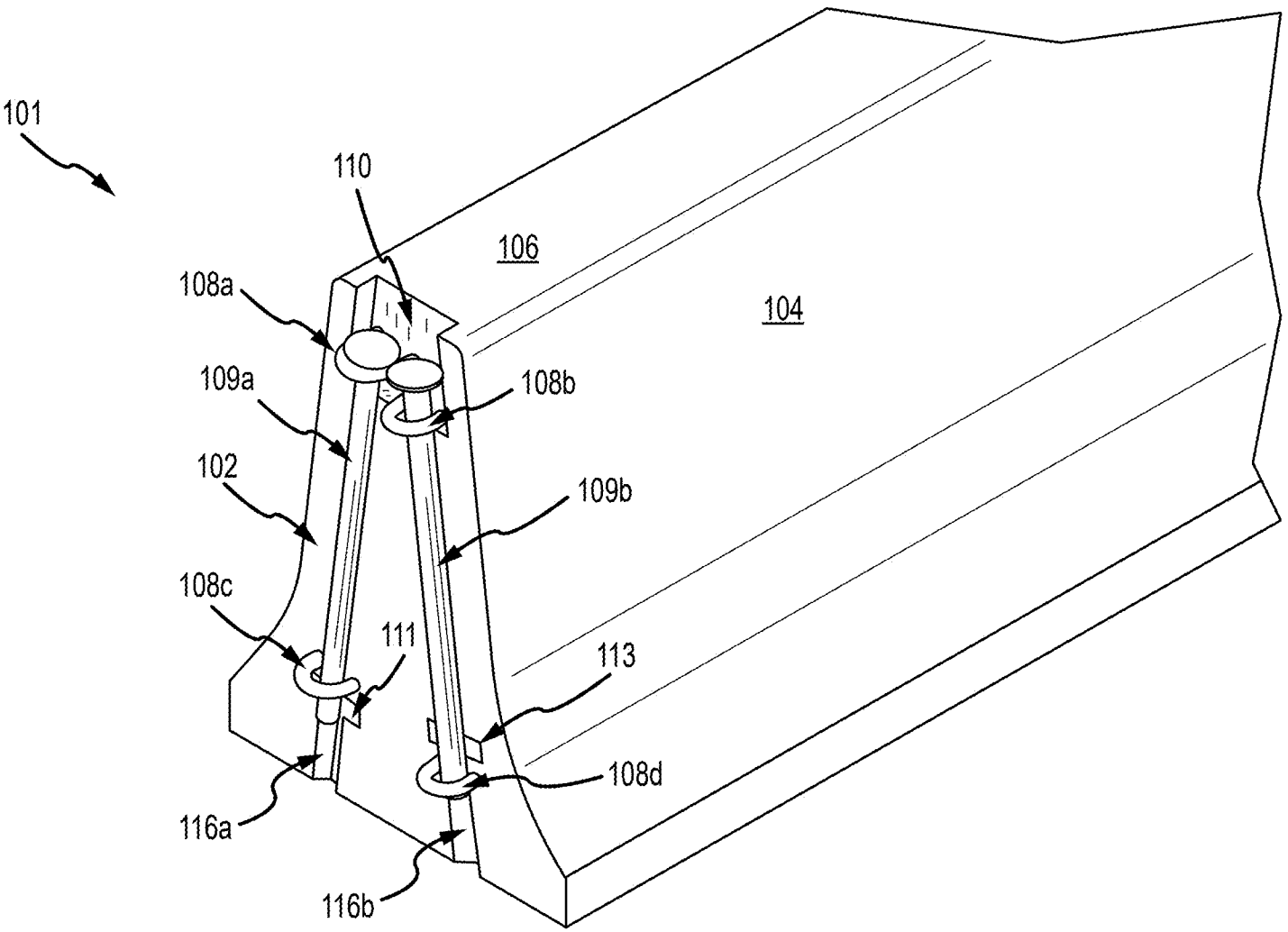
FIG. 11 is a perspective view of the first end of a barrier showing loop recesses and pin recesses for tight and rigid connections between barriers.

FIG. 11 provides a perspective view of a modular traffic barrier 101 of FIG. 10 with two pins 109*a* and 109*b* traveling through two pin recesses 116*a* and 116*b* and spanning through the loops 108*a*, 108*b*, 108*c*, 108*d* of a loop connector on the first end 102 of the barrier 101 (104 is the first side of the barrier, 105 is the second side of the barrier, 106 is the top of the barrier and 103 is the second end). As shown in FIG. 11 and discussed in FIG. 10, loops (108*a*, 108*b*, 108*c*, and 108*d*) extend from the first end 102 of the barrier 101. A first pin, 109*a*, travels from the top recess 110, through the first pin recess 116*a* and spans through loops 108*a* and 108*c* and the second pin 109*b* travels from the pin head recess 110 and through the second pin recess 116*b* and spans through loops 108*b* and 108*d*.

As will be understood by one skilled in the art, while two pins are shown in FIG. 11, in another example, one pin may be used with one pin recess integrated into the barrier along the vertical center or midline of the barrier. In this example, the one pin may span through two, four, six or eight loops, depending on the needs of the connection.

Figure 12:
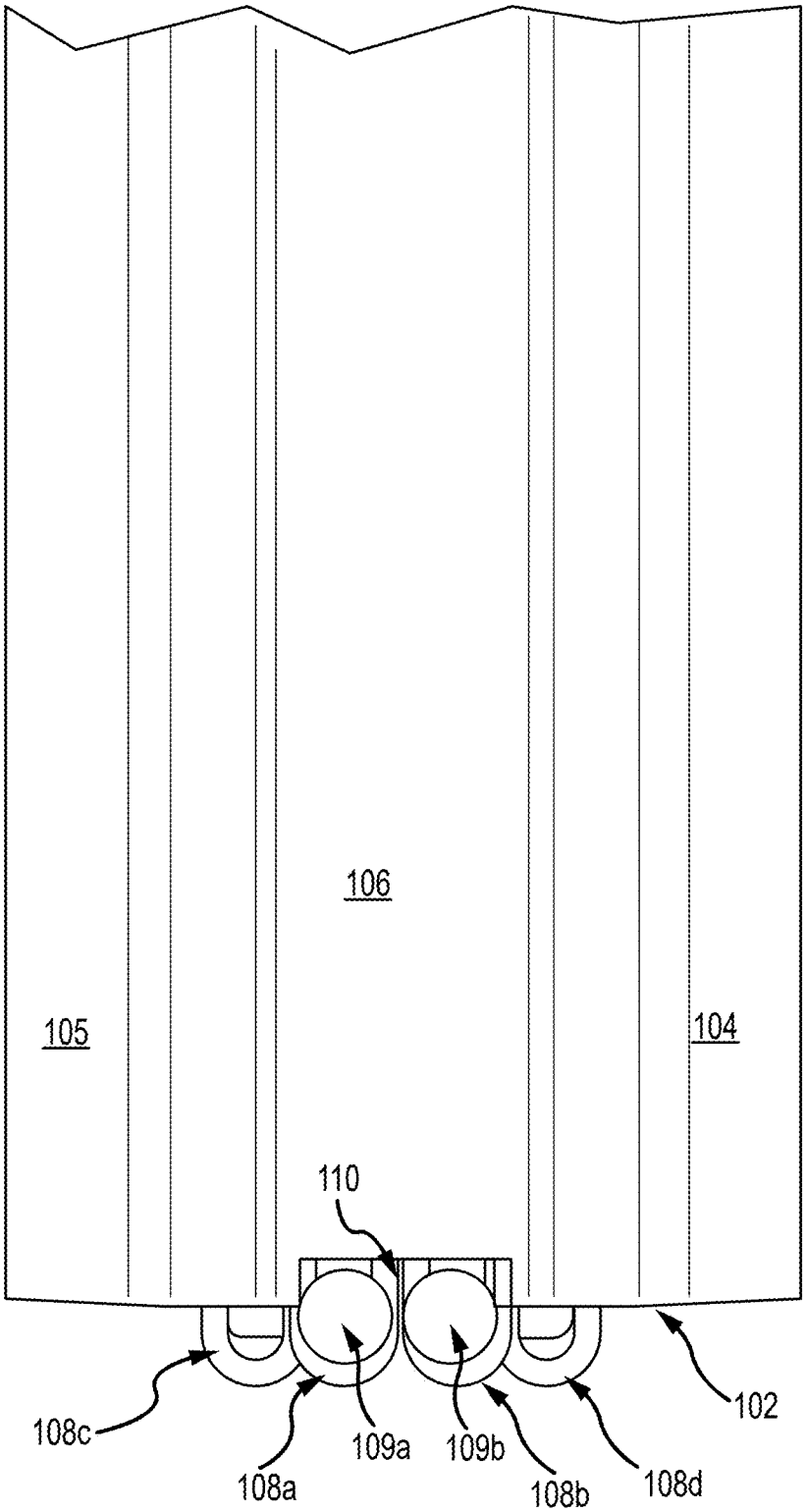
FIG. 12 is a top elevation view of the first end of a barrier showing loop recesses and pin recesses for tight and rigid connections between barriers.

FIG. 12 is a top elevation view of barriers 101 with a rigid connection, showing two pins 109*a* and 109*b* in a pin head recess 110 and spanning loops 108*a*, 108*b*, 108*c*, and 108*d* integrated into the barrier 101. The rigid connection, allows for a tight connection between the ends of two barriers, and will reduce deflections as well as the need for shimming gaps. Further, the rigid connections will act in a similar manner to barriers cast in place and will reduce or eliminate the need for pins to be placed in barriers to prevent or reduce rolling.

FIGS. 13*a* to 13*g* is a series of schematic figures showing the taper of the modular traffic barrier at the various views. FIG. 13*a* is an elevation view of the end of the modular traffic barrier of the current disclosure showing the taper at the top of the barrier and at the bottom of the barrier. FIG. 13*b* is an elevation view of the top of the modular traffic barrier showing the taper of the end of the barrier. FIG. 13*c* is an elevation view of the end of the modular traffic barrier from the center line of the barrier. FIG. 13*d* is a plan view of the barrier from the top of the barrier looking down on the end of the barrier, showing the draft and taper of the end of each barrier.

FIG. 13*e* is a blown-up plan view of the taper of the elevated rights at the top of the end of the modular traffic barrier. As shown in FIG. 13*e*, the widest part of the taper is closest to the centerline of the end of the barrier with the taper narrowing as it extend to the edge or side of the barrier. In this example the width of the elevated ridge traverses from ½" to ⅜", however a variety of widths and taper gradients may be used, as will be understood by one skilled in the art.

FIG. 13*f* is a blown-up plan view of the taper of the elevated ridge at the bottom of the end of the modular traffic barrier. As shown in FIG. 13*f*, the widest part of the taper is closest to the centerline of the end of the barrier with the taper narrowing as it extends to the edge or side of the barrier. In this example the width of the elevated ridge traverses from ⅜" to ¼", however a variety of widths and taper gradients may be used, as will be understood by one skilled in the art.

FIG. 13*g* is a plan view of the top of the end of the modular traffic barrier showing the work line and taper of the barrier in view of the toe of the barrier.

FIGS. 14*a* to 14*e* is a series of schematic figures showing the modular traffic barrier with a single pin connection with the use of a deflection spacer. As shown in FIG. 14*a*, is an elevation view of the end of the modular traffic barrier 101 of the current disclosure is provided with a one pin 109 connection. The barrier 101 in FIG. 14*a* shows the first end of the barrier 101. Three loop recesses 111*a*, 111*b* and 113 are provided which are also designed to allow the loops of the loop connectors (discussed above) space without bumping into the end of the barrier 101. In this example, deflection spacers 128 and 130 are shown at the end of the barrier 101, while elevated ridges may be incorporated into the end of the barrier but are not shown. The deflection spacers 128 and 130 are used to close any gaps in the connection between barriers, allowing for a uniform surface between barriers to allow for a more uniform impact and dispersal of energy in a vehicle impact, reducing the amount of movement of the barrier or barriers. Also shown in FIG. 14*a* is a single pin recess 116 that allows for a pin to be inserted into the barrier loops but integrated into the end of the barrier to reduce the surface area and impact of the pin with the ends of the barriers once the barriers are connected.

FIG. 14*b* is an elevation view of the top of a one pin connection between two modular traffic barriers with deflection spacers used to fill in the gaps between the barriers. As shown in FIG. 14*b*, a single pin 109 is used to connect two barriers 101 with deflection spacers 128 and 130 be incorporated into the end of the barrier to close any gaps in the connection between barriers, allowing for a uniform surface between barriers to allow for a more uniform impact and dispersal of energy in a vehicle impact, reducing the amount of movement of the barrier or barriers. As also shown in FIG. 14*b* a pin recess 116 is used to reduce the surface area of the pin when two barriers are connected, allow a smoother connected between two barriers.

FIG. 14*c* is an elevation view from the side showing the use of a deflection spacer 128 to close the gap 115 in the connection between two barriers 101. In another embodiment, two deflection spacer cleats 132 are shown integrated into the ends of each barrier 101. The deflection spacer cleats 132 are grooved integrated into the end of each barrier that help the deflection spacer 128 slide into the gap between the barriers and also help hold the deflection spacers 128 in place. As shown in FIG. 14*c*, two barriers 101 are connected by a single pin 109.

FIG. 14*d* is an elevation view of two barriers 101 connected to each other by one pin 109 within a pin recess 116. As shown in FIG. 14*d*, the one pin 109 connection between the two barriers 101 allows for more flexibility in the pivot point between the two barriers, allow curves to be created in the barriers with different articulations.

FIG. 14*e* is an elevation view of two barriers 101 connected to each other by one pin 109*a* with a larger curve at the pivot point of the pin109.

The foregoing description of the invention has been presented for purposes of illustration and description. It is not intended to be exhaustive or to limit the invention to the precise form disclosed, and other modifications and variations may be possible considering the above teachings. The embodiment was chosen and described to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A barrier, wherein the barrier comprises:

a first end having a top, a centerline, a first side and a second side; a second end having a top, a centerline, a first side and a second side; a top, a bottom, a first side and a second side;

at least two ridges protruding from said first end of said barrier and at least two ridges protruding from said second end of said barrier, wherein said at least two ridges on the first end and said at least two ridges on said second end allows for a more uniform impact on said first end and said second end of the barrier during a vehicle collision;

at least one loop bar connector operably integrated into the first end of the barrier and at least one loop bar connector operably integrated into the second end of the barrier, wherein said integration allows for at least two loops from each of said at least one first loop bar connector to extend from the first end of the barrier and the at least one second loop bar connector to extend from the second end of the barrier;

wherein each of said at least two loops are configured to allow at least one pin to span through said at least two loops of the loop bar connectors as integrated into the barrier; and at least one pin recess integrated into the first end of said barrier and at least one pin recess integrated into the second end of said barrier, wherein each of said pin recess is configured to allow at one pin to span through said pin recess; and at least two loop recesses integrated into said first end of said barrier and at least two loop recesses integrated into said second end of said barrier, wherein each of said at least two loop recesses allows a loop from an end of a second barrier to be integrated within an end of the barrier.

2. The barrier of claim 1, wherein said barrier further comprises at least one taper on said first side of the first end of the barrier; at least one second taper on said second side of the first end of the barrier; at least one taper on said first side of the second end of the barrier and at least one second taper on said second side of the second end of the barrier.

3. The barrier of claim 1, wherein said barrier is comprised of cement, concrete, steel or steel frame.

4. The barrier of claim 1, wherein said barrier further comprises at least one deflection spacer cleat integrated into the first end of said barrier and at least one deflection spacer cleat integrated into the second end of said barrier.

5. The barrier of claim 1, wherein said barrier further comprises a first pin head recess located at the top of the first end of each of said barrier and a second pin head recess located at the top of the second end of said barrier, wherein each of said pin head recess provides space for heads of one or more pins.

6. The barrier of claim 1, wherein each of said at least two ridges of said first end are tapered with the thickest part of said taper of each of said at least two ridges is closest to the centerline of the first end and wherein each of said at least two ridges of said second end are tapered with the thickest part of said taper of each of said at least two ridges is closest to the centerline of the second end.

7. A system for connecting barriers, where the system comprises:

two barriers, wherein each barrier comprises:

a first end having a top, a centerline, a first side and a second side; a second end having a top, a centerline, a first side and a second side; a top, a bottom, a first side and a second side;

at least two ridges protruding from said first end of said barrier and at least two ridges protruding from said second end of said barrier, wherein said at least two ridges on the first end and said at least two ridges on said second end allows for a more uniform impact on said first end and said second end of the barrier during a vehicle collision;

at least one loop bar connector operably integrated into the first end of the barrier and at least one loop bar connector operably integrated into the second end of the barrier, wherein said integration allows for at least two loops from each of said at least one first loop bar connector to extend from the first end of the barrier and the at least one second loop bar connector to extend from the second end of the barrier;

wherein each of said at least two loops are configured to allow at least one pin to span through said at least two loops of the loop bar connectors as integrated into the barrier; and at least one pin recess integrated into the first end of said barrier and at least one pin recess integrated into the second end of said barrier, wherein each of said pin recess is configured to allow at one pin to span through said pin recess; and at least two loop recesses integrated into said first end of said barrier and at least two loop recesses integrated into said second end of said barrier, wherein each of said at least two loop recesses allows a loop from an end of a second barrier to be integrated within an end of the barrier; and at least one pin, wherein said at least one pin is configured to span through the loops of the loop bar connectors as integrated into the barrier, allowing the first end of the barrier to be operably coupled to the first end or second end of a second barrier by aligning the first end of the barrier with the first end or second end of the second barrier and aligning the loops of the first barrier with the loops of the second barrier to allow at least one pin to span through said at least one loop of the first barrier and through said at least one loop of said second barrier.

8. The system of claim 7, wherein the connection between said first barrier and said second barrier creates a gap between said first barrier and said second barrier, and wherein said system further comprises at least one deflection spacer, wherein said at least one deflection spacer is operably integrated into the gap between the first barrier and the second barrier.

9. The system of claim 8, wherein said at least one deflection spacer is chosen from a shim, wedge and block.

10. The system of claim 8, wherein said first barrier and said second barrier further comprises at least one deflection spacer cleat integrated into the first end of said first barrier and said second barrier and at least one deflection spacer cleat integrated into the second end of said first barrier and said second barrier and wherein each of said at least one deflection spacer clear on the first and second end of said first barrier and said second barrier allow said deflection spacer to slide into the gap between the barriers and to hold the deflection spacers in place.

11. The system of claim 6, wherein each of said two barriers further comprises at least one taper on said first side of the first end of said barriers, at least one second taper on said second side of the first end of said barriers, at least one taper on said first side of the second end of each of said barriers, at least one second taper on said second side of the second end of said barriers.

12. The system of claim 7, wherein said two barriers further comprise a first pin head recess located at the top of the first end of each of said at least two barriers and a second pin head recess located at the top of the second end of each of said at least two barriers, wherein each of said pin head recess provides space for heads of one or more pins connecting two barriers together.

13. The system of claim 7, further comprising one or more additional barriers, wherein each of said one or more additional barriers are operably connected to either the first end or the second end of one of said two barriers to create a chain of three or more barriers.

14. The system of claim 7, wherein the shape of said loops are chosen from square, rectangular, round, oval, and hexagon.

15. The system of claim 7, wherein the shape of said pins are chosen from square, rectangular, round, oval, and hexagon.

16. The system of claim 7, wherein each of said at least two ridges of said first end are tapered with the thickest part of said taper of each of said at least two ridges is closest to the centerline of the first end and wherein each of said at least two ridges of said second end are tapered with the thickest part of said taper of each of said at least two ridges is closest to the centerline of the second end.

17. A method for connecting two barriers, wherein the method comprises:

providing two barriers, wherein each barrier comprises:

a first end having a top, a centerline, a first side and a second side; a second end having a top, a centerline, a first side and a second side; at top, a bottom, a first side and a second side;

at least two ridges protruding from said first end of said barrier and at least two ridges protruding from said second end of said barrier, wherein each of said at least two ridges of said first end are tapered with the thickest part of said taper of each of said at least two ridges is closest to the centerline of the first end and wherein each of said at least two ridges of said second end are tapered with the thickest part of said taper of each of said at least two ridges is closest to the centerline of the second end, and wherein said at least two ridges on the first end and said at least two ridges on said second end allows for a more uniform impact on said first end and said second end of the barrier during a vehicle collision;

at least one loop bar connector operably integrated into the first end of the barrier and at least one loop bar connector operably integrated into the second end of the barrier, wherein said integration allows for at least two loops from each of said at least one first loop bar connector to extend from the first end of the barrier and the at least one second loop bar connector to extend from the second end of the barrier;

wherein each of said at least two loops are configured to allow at least one pin to span through said at least two loops of the loop bar connectors as integrated into the barrier; and at least one pin recess integrated into the first end of said barrier and at least one pin recess integrated into the second end of said barrier, wherein each of said pin recess is configured to allow at one pin to span through said pin recess; and at least two loop recesses integrated into said first end of said barrier and at least two loop recesses integrated into said second end of said barrier, wherein each of said at least two loop recesses is allows a loop from an end of a second barrier to be integrated within an end of the barrier; and providing at least one pin, wherein said at least one pin is configured to span through the loops of the loop bar connectors as integrated into the barrier, allowing the first end of the barrier to be operably coupled to the first end or second end of a second barrier by aligning the first end of the barrier with the first end or second end of the second barrier and aligning the loops of the first barrier with the loops of the second barrier to allow at least one pin to span through said at least one loop of the first barrier and through said at least one loop of said second barrier.

18. The method of claim 15, wherein the connection between said first barrier and said second barrier creates a gap between said first barrier and said second barrier; and wherein said method further comprises:

providing at least one deflection spacer, wherein said at least one deflection spacer is operably integrated into gap between the first barrier and the second barrier.

19. The method of claim 18, wherein said at least one deflection spacer is chosen from a shim, wedge and block.

20. The method of claim 18, wherein said first barrier and said second barrier further comprises providing at least one deflection spacer cleat integrated into the first end of said first barrier and said second barrier and at least one deflection spacer cleat integrated into the second end of said first barrier and said second barrier and wherein each of said at least one deflection spacer clear on the first and second end of said first barrier and said second barrier allow said deflection spacer to slide into the gap between the barriers and to hold the deflection spacers in place.

21. The method of claim 17, wherein each of said two barriers further comprises at least one taper on said first side of the first end of said barriers, at least one second taper on said second side of the first end of said barriers, at least one taper on said first side of the second end of each of said barriers, at least one second taper on said second side of the second end of said barriers.

22. The method of claim 17, wherein said two barriers further comprise:

providing a first pin recess located at the top of the first end of each of said at least two barriers and a second pin recess located at the top of the second end of each of said at least two barriers, wherein each of said pin recess provides space for heads of one or more pins connecting two barriers together.

23. The method of claim 17, wherein said two barriers further comprises:

providing at least two loop recesses integrated into said first end and at least two loop recesses integrated into said second end, wherein each of said at least two loop recesses is designed to allow for at least two loops from an end of a second barrier to be integrated within an end of the barrier.

24. The method of claim 17, further comprising:

providing one or more additional barriers, and operably coupling each of said one or more additional barriers to either the first end or the second end of one of said two barriers to create a chain of three or more barriers.

25. The method of claim 17, wherein the shape of said loops are chosen from square, rectangular, round, oval, and hexagon.

26. The method of claim 17, wherein the shape of said pins are chosen from square, rectangular, round, oval, and hexagon.

27. The method of claim 17, wherein each of said at least two ridges of said first end are tapered with the thickest part of said taper of each of said at least two ridges is closest to the centerline of the first end and wherein each of said at least two ridges of said second end are tapered with the thickest part of said taper of each of said at least two ridges is closest to the centerline of the second end.

* * * * *